US006605982B2

(12) United States Patent
Callahan, Jr.

(10) Patent No.: US 6,605,982 B2
(45) Date of Patent: Aug. 12, 2003

(54) BIAS CIRCUIT FOR A TRANSISTOR OF A STORAGE CELL

(75) Inventor: Michael J. Callahan, Jr., Austin, TX (US)

(73) Assignee: STMicroelectronics Inc., Carrollton, TX (US)

( * ) Notice: Subject to any disclaimer, the term of this patent is extended or adjusted under 35 U.S.C. 154(b) by 0 days.

(21) Appl. No.: 09/895,492

(22) Filed: Jun. 29, 2001

(65) Prior Publication Data

US 2003/0001662 A1 Jan. 2, 2003

(51) Int. Cl.[7] ..... G05F 1/10
(52) U.S. Cl. ..... 327/535
(58) Field of Search ..... 327/111, 112, 327/374, 376, 377, 534, 535, 537

(56) References Cited

U.S. PATENT DOCUMENTS

| | | | | | |
|---|---|---|---|---|---|
| 5,281,862 | A | * | 1/1994 | Ma | 326/128 |
| 5,404,051 | A | * | 4/1995 | Kobayashi | 327/108 |
| 5,729,165 | A | * | 3/1998 | Lou et al. | 326/88 |
| 5,754,078 | A | * | 5/1998 | Tamagawa | 330/255 |
| 5,900,756 | A | | 5/1999 | Drouot | 327/170 |
| 5,982,207 | A | * | 11/1999 | Wilcox | 327/112 |
| 6,362,609 | B1 | * | 3/2002 | Gailhard | 323/280 |

* cited by examiner

*Primary Examiner*—Jeffrey Zweizig
(74) *Attorney, Agent, or Firm*—Lisa K. Jorgenson; Andre Szuwalski

(57) ABSTRACT

An integrated circuit includes storage circuits comprising isolation transistors to which a certain bias voltage may be applied. The bias voltage is generated by a bias voltage generator. A boost circuit responds to initial bias voltage transition by generating a boost current that is applied to the isolation transistors with the transitioning bias voltage.

34 Claims, 6 Drawing Sheets

BIAS CIRCUIT FOR A TRANSISTOR OF A STORAGE CELL

CROSS-REFERENCE TO RELATED PATENT

The present application is related to commonly-owned U.S. Pat. No. 5,900,756, issued May 4, 1999, the disclosure of which is incorporated by reference herein.

BACKGROUND OF THE INVENTION

1. Technical Field of the Invention

The present invention relates to integrated circuits and, in particular, to a bias circuit for a programmable storage cell that utilizes a floating-gate transistor as a storage unit.

2. Description of Related Art

Read-only memories are commonly organized in matrix form, utilizing rows and columns. The rows are referred to as bit rows, and the columns are referred to as word columns. Each intersection of a row and column forms a storage cell whose electrical state represents an information element. Depending on the technology used, these storage cells are programmable one or more times, and they can be erased individually or comprehensively.

The rows and the columns of the memories are generally tested following production to ensure that access can be made to all the storage cells of the memories and that each cell can be programmed and erased in such a way that there is definite knowledge, at any time, of the electrical state of the storage cells.

A programmable memory circuit typically comprises a floating-gate transistor, commonly called a fuse, that is series-connected with a current source. Each floating-gate transistor represents one address bit. Depending on the electrical state of the floating-gate transistor (i.e., whether there are electrons present at its gate), the fuse behaves like an open circuit or like a resistor. If it behaves like a resistor, it may conduct current. On the contrary, if it behaves like an open circuit, it can not conduct current. A current detector may then be used to read the data stored therein by detecting the currents flowing at each fuse.

Reference is now made to FIG. 1 wherein there is shown an integrated circuit 1 in accordance with U.S. Pat. No. 5,900,756. The circuit 1 includes a plurality of storage circuits 2 (not all of which are represented). Each storage circuit 2 includes a cell referred to as a fuse. More specifically, the fuse is a floating-gate transistor 3 that is series connected with an N type isolation transistor 4 between a reference terminal 5 and a supply terminal 6. Typically, the reference terminal 5 gives a ground potential GND and the supply terminal 6 gives a positive supply potential VCC of the order of some volts (for example, five volts).

The floating-gate transistor 3 is connected through its control gate, by means of a circuit (not explicitly shown), to either the ground potential GND or the supply potential VCC. The source of transistor 3 is connected to the ground terminal 5 and the drain of transistor 3 is connected to the source of the isolation transistor 4. The isolation transistor 4 has its drain connected through a resistor 25 to the supply terminal 6.

A programming and reading circuit 7 is connected to the drain of the floating-gate transistor 3 and is also connected to the drain of the isolation transistor 4. In a first mode of operation referred to as a "programming mode," the circuit applies a voltage of some volts to the floating-gate transistor 3, with the control gate of this transistor 3 being connected to ground. In a second mode of operation referred to as a "reading mode," the circuit 7 detects a possible passage of current through resistor 25 and hence into the floating-gate transistor 3. This passage of current depends on the electrical state of the floating-gate transistor 3 (namely the presence or non-presence of electrons on the floating gate),.

More specifically, the circuit 2 operates in the following manner:

- in programming mode, depending on the electrical state desired, a high value (for example, 10 volts) is applied (or not applied) on the drain of the floating-gate transistor in order to inject (or not inject) electrons into the floating gate, the control gate of the floating gate transistor is connected to ground, and the control gate of the isolation transistor is also connected to ground; and
- in reading mode (i.e., current passage detection to read the addressed bit), the N type isolation transistor is biased positively at its control gate in order to be turned on, and the control gate of the floating-gate transistor is connected to a positive supply potential VCC given by the supply terminal.

When configured in the reading mode, the isolation transistor is on and a current may flow, as the case may be, depending on the electrical state of the floating-gate transistor. The isolation transistor is used to impose a constant voltage on the drain of the floating-gate transistor to have the same reading conditions whatever the current given by the supply terminal. In this case, the current read is only a function of the threshold voltage of the floating-gate transistor, and this threshold voltage varies according to the electrical state of this transistor.

To impose a constant voltage on the drain of the floating-gate transistor, a constant bias voltage is imposed on the isolation transistor. This bias voltage is typically twice the threshold voltage Vt of the isolation transistor (wherein typically Vt is approximately one volt). A low bias voltage is chosen in order to limit the current produced and hence the consumption of the circuit.

A bias circuit, capable of giving adequate voltage in programming mode (for the connection to the ground of the control gate of the isolation transistors), is accordingly needed to operate the circuit 2. Irrespective of the mode of operation in effect, the bias circuit must provide the proper bias voltage. This is the case, for example, in a watch mode of operation wherein the memory is supplied with bias but is not currently being used for reading or writing. It is preferable that the bias circuit operate as quickly as possible during the activation of the memory (for example, when reading and writing).

The integrated circuit 1 accordingly includes a first bias circuit 8 having a control terminal 10 and an output terminal 11. The first bias circuit 8 is formed by two arms, each arm consisting of series-connected transistors between the supply terminal 6 and the ground terminal 5. A first arm 12 has a P type transistor 14*a* whose source is connected to the supply terminal 6 and whose drain is connected to the drain of an N type transistor 15*a*.The source of the N type transistor 15*a* is connected to the drain and to the control gate of an N type transistor 16*a*, configured as a diode, with the source of transistor 16*a* being connected to the ground terminal 5. The second arm 13 of the first bias circuit 8 similarly includes a P type transistor 14*b* whose source is connected to the supply terminal 6 and whose drain is connected to the drain of an N type transistor 15*b*. The source of this N type transistor 15*b* is connected to the drain and to the control gate of an N type transistor 17, configured as a diode. The source of the transistor 17 is connected to the drain and to the control gate of an N type transistor 16*b*, also configured as a diode, with the source of transistor 16*b* being connected to the ground terminal 5. The control gates of the P type transistors 14*a* and 14*b* are connected to each other and to the control terminal 10. The control gate of the N type transistor 15*b* of the second arm 13 is connected to the drain of the P type transistor 14*a* of the first arm 12. The control gate of the N type transistor 15*a* of the first arm 12 is connected to the source of the N type transistor 15*b* of the second arm 13. The source of transistor 15*b* is further connected to the output terminal 11. The first bias circuit 8 further includes an N type transistor 18 mounted at the output between the output terminal 11 and the ground terminal 5. This output N type transistor 18 has its control gate connected to the control terminal 10.

A brief description of the operation of the first bias circuit 8 will now be provided. The control terminal 10 receives a first binary control signal VB0. The output terminal 11 supplies a binary bias voltage VB to the storage circuits 2. This bias voltage VB takes a first binary value when the first control signal VB0 is in a first state (VB0=1) and a second binary value when the first control signal VB0 is in a second state (VB0=0).

If Vt designates the threshold voltage of the isolation transistor 4, then the first binary value of VB is equal to the ground potential GND and the second binary value of VB is equal to 2*Vt. The first binary value of VB corresponds to an operation that isolates the floating-gate transistor 3 from the current source formed by the resistor 25 and the supply terminal 6 (for use in programming mode operation). The second binary value of VB corresponds to an operation that connects the floating-gate transistor 3 to this current source (for use in reading mode operation).

This first bias circuit 8 is a source of current-controlled voltage (if VB0=0, of course). The P type transistor 14*a* acts as a resistor, whereas transistors 15*a* and 15*b* operate in a feedback manner to keep the voltage at the control electrode of transistor 15*b* at a predictable potential. This in turn guarantees a predictable potential VB at the terminal 11. Should the resistance of transistor 14*a* vary with process, causing the current through transistor 14*a* to increase, the connection of transistor 15*b* causes the device 15*a* to decrease its current, which tends to counteract the original change. Thus, by negative feedback, it is ensured that there will be a precise and stable bias voltage VB available at the output 11.

The transistors 16*b* and 17 that are connected as diodes on the second arm 13 between the output terminal 11 and the ground terminal 5 enable the fixing of the bias voltage VB as a value equivalent to two threshold voltages Vt when VB0=0. The N type output transistor 18 enables the rapid pulling of the output terminal 11 to the ground potential GND when the connection between the floating-gate transistors 3 of the storage circuits 2 and the corresponding current sources (VB0=1) is cut. Furthermore, this makes it possible to ensure a known value of the voltage VB present at this time at the output terminal 11. This is important because it is possible that there might be a floating node at this place by parasitic capacitive effect.

FIG. 2A illustrates the temporal evolution of the output bias voltage VB using the circuit 8 in response to a step transition of VB0 from one to zero.

A present trend in the design of circuits 1 of the foregoing type leans towards the development of integrated circuits that work with variable supply voltage values. For example, circuits are being developed that can work as well with a 3-volt supply voltage as has been experienced with a 5-volt supply voltage. However, the bias circuit should be capable of supplying the positive bias voltage at high speed (typically within less than one μsec). The bias circuit 8 described above is relatively fast and consumes little power when operating at five volts (see, FIG. 2A) . However, this circuit, along with other comparable biasing circuits, is not suitable for low supply voltages (for example, on the order of three volts) because their build-up time to VB unsatisfactorily exceeds one μsec.

A second bias circuit 9 is accordingly provided to give a bias voltage to the isolation transistors having a response time constant that is relatively fast for supply voltages on the order of 3 volts. The second bias circuit 9 has an output terminal 19 and a control terminal 20. The input of an inverter 21 is connected to the control terminal 20. The output of this inverter 21 is connected to the output terminal 19 by means of a capacitor 22. The inverter 21 is made in a standard way by the series-connection of P and N type transistors 23 and 24 between a supply terminal 6 and a reference terminal 5.

The control terminal 20 of the second bias circuit 9 receives a second binary control signal VB0. The output terminal 19 of this second bias circuit supplies a binary bias voltage VB to the storage circuits 2. This bias voltage VB assumes a first binary value when the second control signal VB0 is in a first state (VB0=1) and a second binary value when said second control signal VB0 is in a second state (VB0=0).

FIG. 2B illustrates the temporal elevation of the output voltage VB using only the circuit 9 in response to a step transition of VB from one to zero.

Preferably, the output terminal 19 and the control terminal 20 of the second bias circuit 9 are connected to the corresponding terminals of the first bias circuit 8. Similarly, the supply terminal 6 and the ground terminal 5, as used by the two bias circuits 8 and 9, are identical.

FIG. 2C illustrates the temporal elevation of the output voltage VB when the circuits 8 and 9 are used together. This illustrates an improvement in response time (delta t) that is experienced with use of both circuits 8 and 9 in low voltage (for example, three volts) environment.

While the foregoing circuit 1 is relatively simple to implement and effectively provides extra current during charging time, the duration of the extra current that is supplied is controlled by an analog differentiation circuit that is somewhat uncorrelated with the capacitance of the bias voltage supply line leading to each of the circuits 2. This raises several concerns. First, the extra amount of charge that is supplied is mostly dependent upon the supply voltage and is therefore uncorrelated with bias voltage that is mostly constant. Second, the size of the boost capacitor 22 must be carefully chosen dependent on the size of the memory array. More specifically, it is recognized that the total capacitive load on the bias line is affected by both thin and thick oxide components. Accordingly, it is somewhat uncorrelated with the capacitance of the boost capacitor 22. If the boost capacitor 22 value is chosen too small, then inadequate extra charge is delivered during boost, and a slow response results. If, on the other hand, the boost capacitance value is too large (either from initial selection or process variations), then the bias voltage line will be boosted too much and extra time will be required to settle the bias voltage line back down to a desired voltage value. Third, the bias voltage itself is recognized to have a temperature coefficient. This means that the theoretically perfect amount of boost charge varies with temperature.

It is accordingly recognized that the prior art circuit of FIG. 1 suffers from a number of controllability concerns, and a need exists for a circuit that addresses these concerns while still being able to provide extra boost current needed to achieve a rapid response time.

SUMMARY OF THE INVENTION

A bias circuit includes a bias voltage generator and a boost circuit. The bias voltage generator produces a voltage signal that transitions from a first value to a second value in response to a change in a control signal. The boost circuit responds to the transition of the voltage signal from the first value by generating a boost current. The voltage signal and boost current are combined to provide an output bias voltage.

A method for generating an output bias voltage includes the step of generating a voltage signal that transitions from a first value to a second value in response to a change in a control signal. The transition of the voltage signal from the first value is then detected causing the generation of a boost current. The voltage signal and the boost current are then combined to provide an output bias voltage.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 2A:
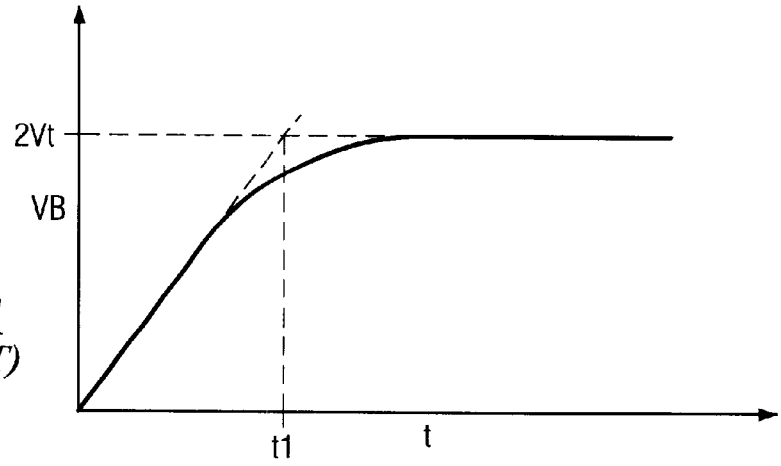
FIG. 2A (PRIOR ART)
FIGS. 2A–2C, previously described, illustrate temporal evolutions of bias voltage response in connection with the circuit of FIG. 1.
Figure 2B:
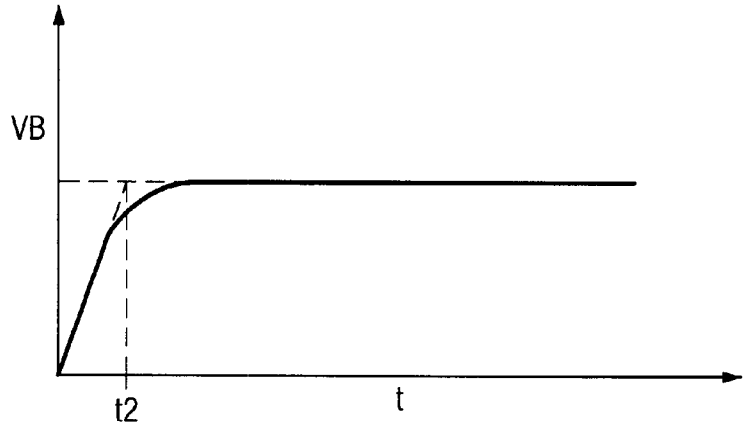
FIG. 2B (PRIOR ART)
Figure 2C:
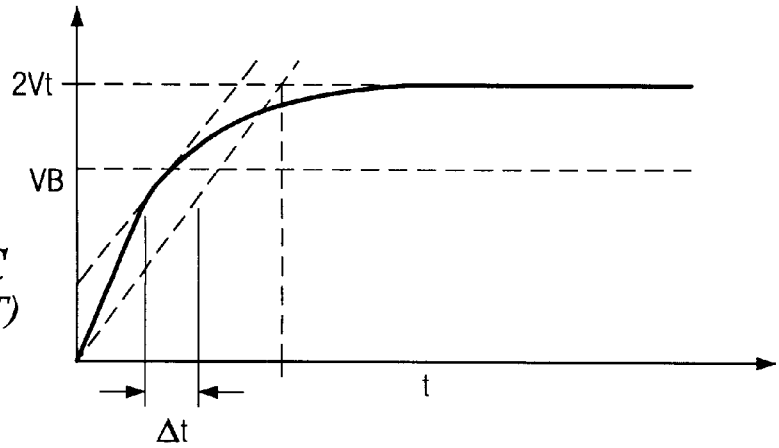
FIG. 2C (PRIOR ART)
Figure 3:
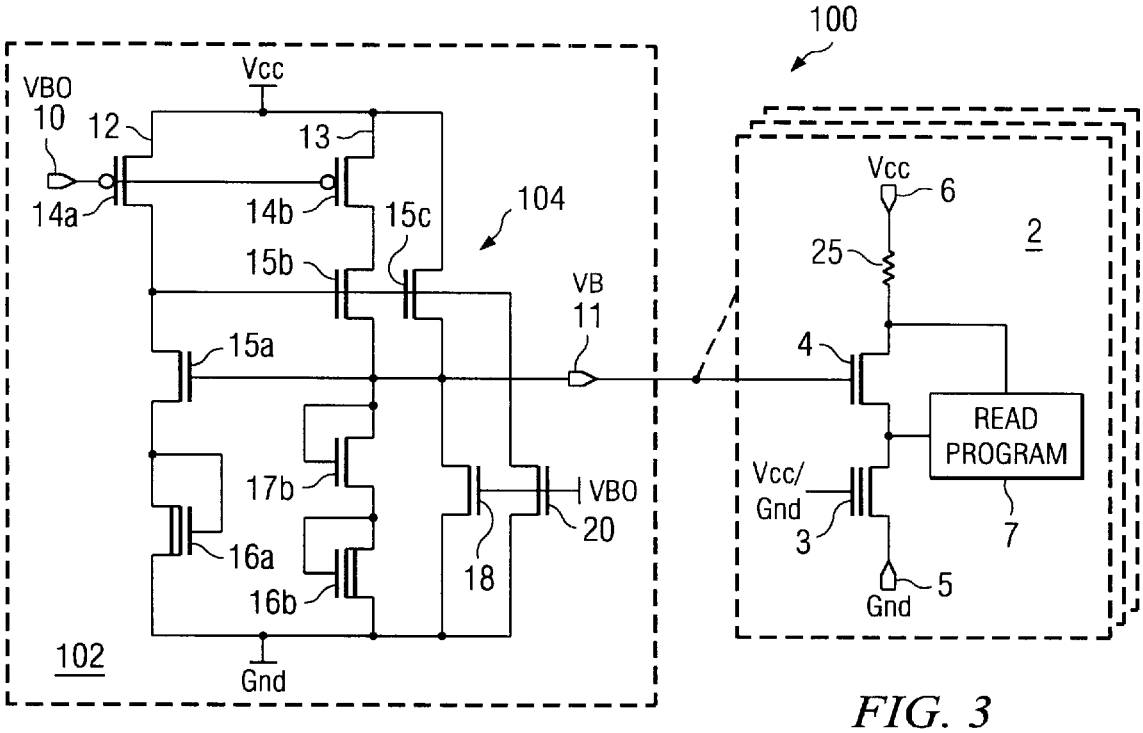
FIG. 3 is a circuit diagram illustrating an integrated circuit in accordance with the present invention.

Reference is now made to FIG. 3 wherein there is shown an integrated circuit 100 in accordance with the invention. The circuit 100 shares a number of common components with the circuit 1 of FIG. 1. Common reference numbers are used for these shared common components, and the description of FIG. 3 incorporates by reference the prior description of these common components. No further discussion of these common components, except to the extent necessary to explain operation of the circuit 100, will be provided. The circuit 100 includes a bias circuit 102 that generates a bias voltage in the manner discussed above and illustrated in FIG. 2A. The circuit 100 further includes a boost current circuit 104 whose operation will be described.

The bias circuit 102 (also reference 8 for the circuit 1 of FIG. 1) is somewhat slow to respond to changes in VB0 because the N type transistor 15*b* is current limited by the P type transistor 14*b*. The transistor 15*b* acts like a source follower with a significant resistance in its drain circuit.

Figure 1:
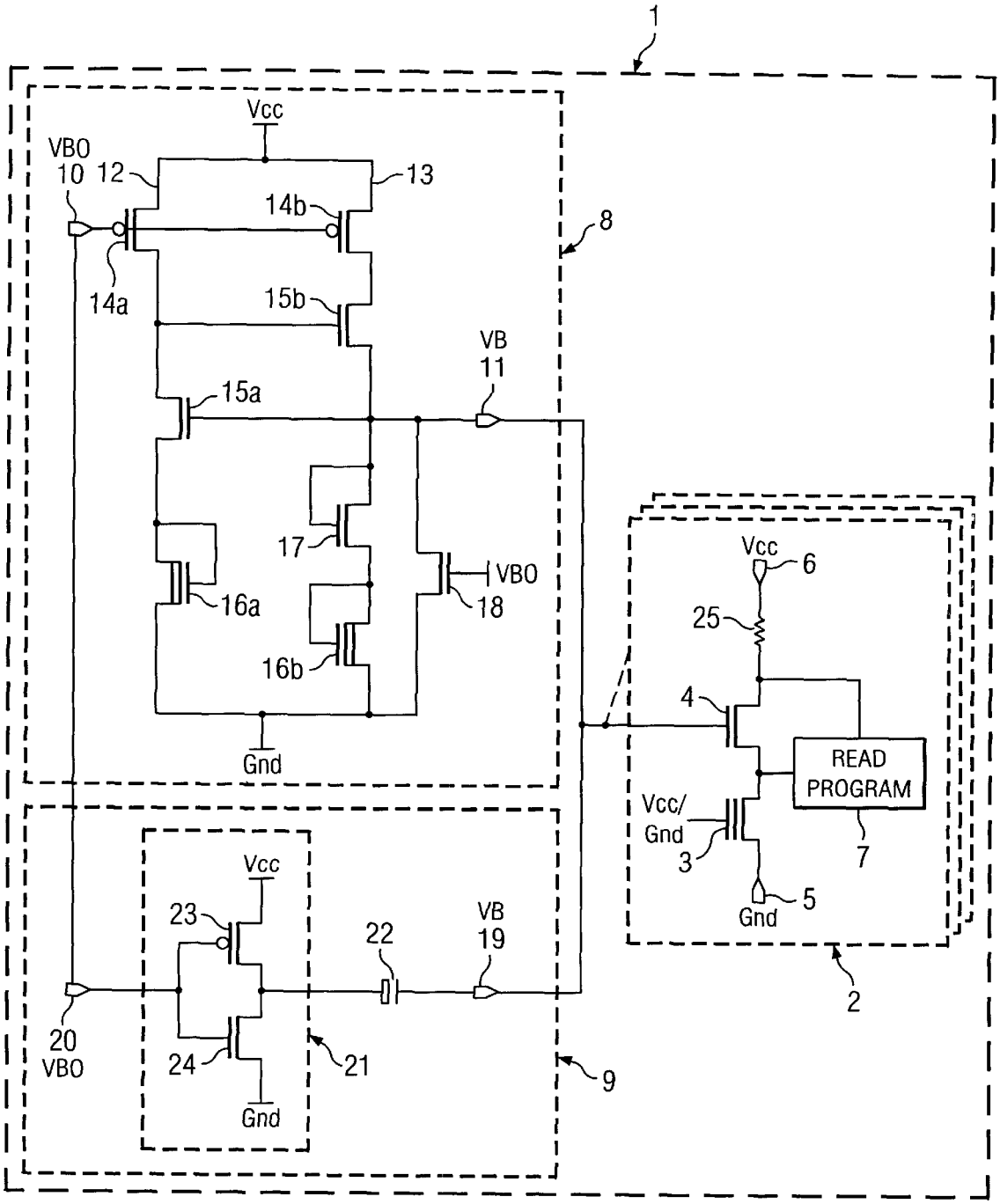
FIG. 1 (PRIOR ART)
FIG. 1, previously described, is a circuit diagram illustrating an integrated circuit in accordance with U.S. Pat. No. 5,900,756.

The foregoing problems are addressed by the circuit 100 of FIG. 3 that comprises the bias circuit 102 (also referred to as a reference bias generator) and a boost current circuit 104 (also referred to as a bias driver) to replace the second bias circuit 9 of FIG. 1 and supplement the operation of the circuit 102 to provide faster response for the bias voltage. The boost current circuit 104 includes an N type transistor 15*c* whose drain is connected to the supply terminal 6 and whose source is connected to the output terminal 11. The control gate of the transistor 15*c* is connected to the control gate of the transistor 15*b* (that is connected, as previously described, to the drain of the P type transistor 14*a* of the first arm 12). The circuit 100 further includes an N type transistor 20 whose drain is connected to the control gate of the transistors 15*b* and 15*c* (as well as the drain of the P type transistor 14*a*). The source of transistor 20 is connected to the ground terminal 5. The control gate of transistor 20 is connected to the control gate of the transistor 18 (that is connected, as previously described, to the control terminal 10).

In this first embodiment, the transistor 15*c* is conveniently sized from one-half to two times the size of transistor 15*b*.

Under transient conditions, transistor 15*c* acts as a true source follower (or voltage follower) and delivers only as much current as the capacitive load (represented by the storage circuits 2) requires. However, in normal, quiescent, operation the transistor 15*c* advantageously does not cause any more current to be drawn than would have been experienced with the prior art circuit. Upon start-up, the transistor 15*c* has a very large gate-to-source voltage so that it reacts immediately to a transition in the generated bias voltage from, for example, zero volts with generation of a significant amount of charging (boost) current to rapidly charge up the capacitive bias line at the output terminal 11. Initially, the transistor 15*c* can deliver more charge current than transistor 15*b* because it has no significant impedance in its drain circuit. The circuit operates with series negative feedback, and thus when the capacitive bias line is charged up to the proper voltage the boost current delivered from the transistor 15*c* is automatically reduced. Rapid charging of the bias line for a selected circuit 2 is thus provided, and this allows for a faster reading of the associated, selected, memory cell. Notably, the transistor 15*c* only supplies this extra boost current when needed.

The transistor 20 provides an important safety feature for the circuit 100. VB0 is the turn-off command for the circuit 102. Transistor 18 responds to this command by pulling the output terminal 11 (and also the source of transistor 15*c*) to ground. At the same time, transistor 20 pulls the gates of transistors 15*b* and 15*c* to ground. If transistor 20 were not present, then when transistor 18 pulls the source of transistor 15*c* to ground, a large current (on the order of a few milliamps) could flow through transistor 15*c* and transistor 18. While this may not be significant enough to destroy any of the devices, this current may persist for a while in the absence of transistor 20 since the gate potential of transistor 15*c* is floating. Transistor 20 operates to pull the gate of transistor 15*c* to ground and provide an added level of assurance that the circuit 102 is turned off.

Figure 4:
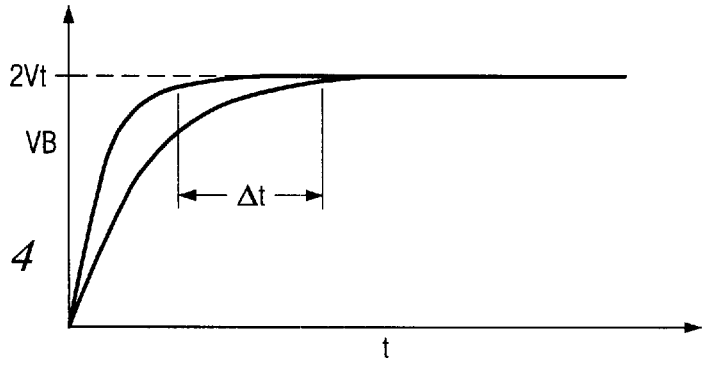
FIG. 4 illustrates a temporal evolution of the bias voltage response in connection with the circuit of FIG. 3.

The circuit 102 is faster in operation than the circuit 1 using only bias circuit 8 as shown in FIG. 1 (see, delta t in FIG. 4 in comparison to FIG. 2A). One reason for this is because transistor 15*c* quickly provides extra charging (boost) current responsive to initial transition of the bias voltage and continues to supply the current for as long as the bias voltage has not reached the desired value. Still further, the circuit 102 utilizes less silicon area due to the fact that there is no need for a capacitor 22. In addition, there are no matching or correlation issues with respect to the capacitance of the capacitor 22 and the distributed capacitance of the remainder of the circuit 102. More specifically, the circuit 102 is not plagued by the difficulties associated with setting the separate time constant for the bias circuit 9. Still further, operation of the circuit 102 has substantially no dependence on the supply voltage or temperature. Another advantage of the circuit 102 is that it works well without significant tuning and with different sized memory arrays and therefore with different capacitance loading.

Figure 5A:
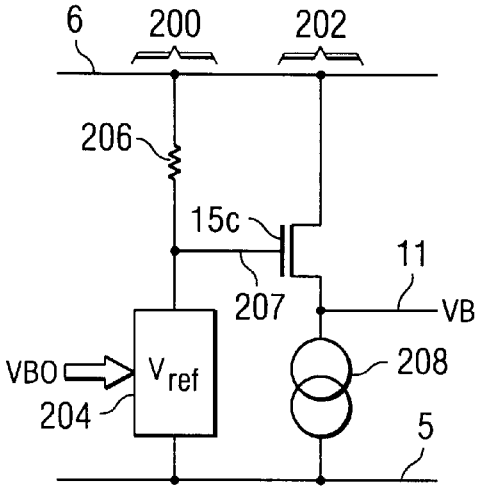
FIGS. 5A and 5B show generic representations of the circuit of FIG. 3.

Reference is now made to FIG. 5A wherein there is shown a generic representation of the circuit 102. This generic representation includes a reference side 200 that generates the required bias voltage (for example, 3*Vt at node 207) and a voltage follower 202 configured to supply a significant amount of drive current with little quiescent current. The desired VB=2*Vt exists at output 11. A general implementation of this generic representation is shown in FIG. 5A comprising a reference voltage generator 204 connected in series with a resistor 206 between the supply terminal 6 and reference terminal (ground) 5. The generator 204 and resistor 206 operate responsive to VB0 application to generate an output bias voltage (VB) at output 11. The voltage follower 202 comprises the transistor 15*c* with its gate connected to receive the output of the generator 204 on line 207. The drain of the transistor 15*c* is connected to the supply terminal 6. The source of the transistor 15*c* is connected to the output terminal 11 and to a current source 208 that is connected to ground 5. In operation, the generator 204 supplies the appropriate voltage for the bias operation, but its response time when driving significant capacitance is too slow. To enhance operation, the circuit of FIG. 5A utilizes the transistor 15*c* connected in a voltage follower configuration to not only pass the generator 204 provided output voltage on line 207 to terminal 11, but also (in transient conditions with ramp up of generator 204 bias voltage output at the gate of transistor 15*c*) deliver a significant amount of boost current to charge the bias output line at terminal 11 (see, also, FIG. 4). As the bias voltage at output 11 reaches its 2*Vt target, the boost current supplied by the transistor 15*c* automatically reduces down to a small quiescent value determined by bias current 208.

Figure 5B:
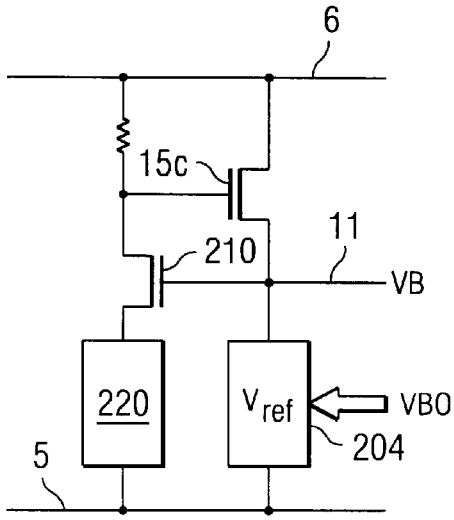

FIG. 5B illustrates an alternative representation where current source 208 in the voltage follower 202 is replaced by the reference voltage generator 204 (which in this case may, for example, be 2*Vt), and the gate of transistor 15*c* is connected to ground 5 by an N type transistor 210 and optimal load device 220. The gate of transistor 210 is connected to the output of the reference voltage generator 204. Operation in this circuit is analogous to that described above in connection with FIG. 5A. The gate of transistor 15*c* is connected to detect generation of the bias voltage by the generator 204 and responds thereto with source generation of the boost current to rapidly charge the output terminal 11.

Although not specifically illustrated, the generic representations of FIGS. 5A and 5B may also include the safety features provided by the transistors 18 and 20 as described above in connection with the operation of FIG. 3.

Figure 6:
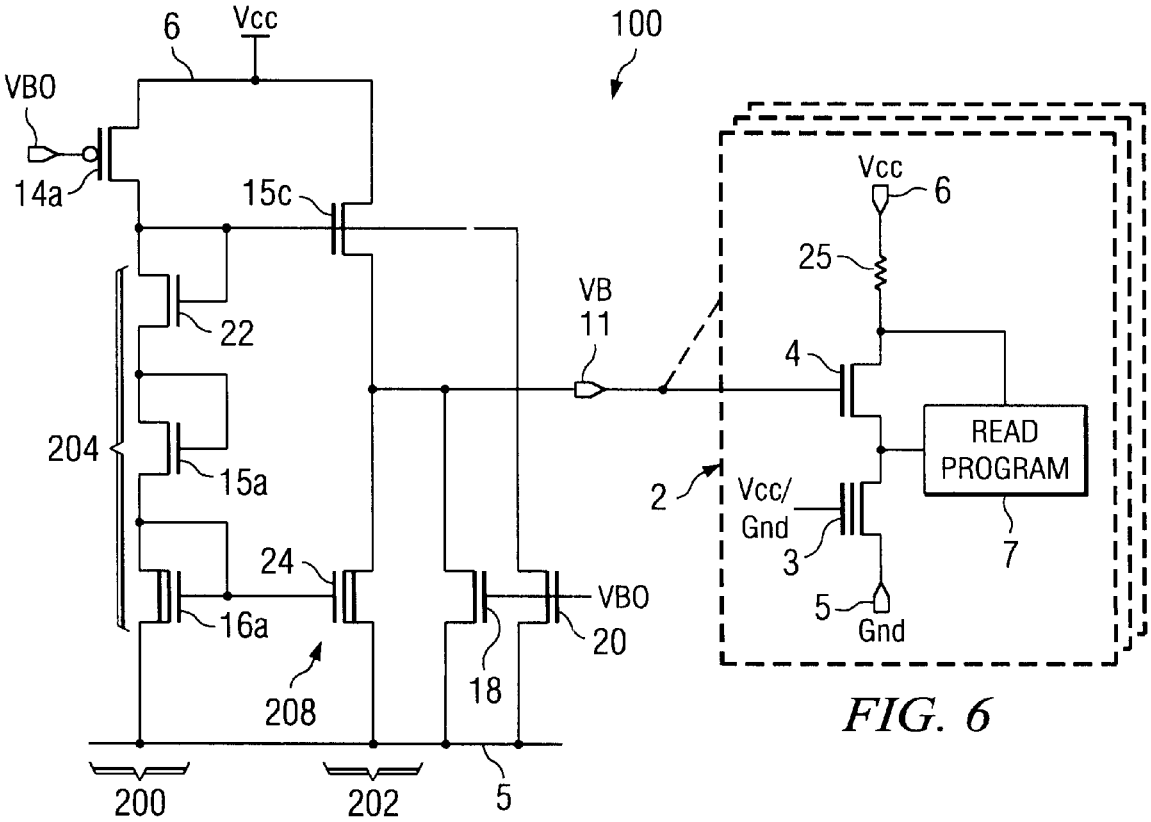
FIGS. 6–10 are circuit diagram of various embodiments of the circuit of FIGS. 3, 5A and 5B.

Reference is now made to FIG. 6 wherein there is shown a specific circuit implementation for the generic representation of circuit 100 as illustrated in FIG. 5A. Again, common reference numbers are used in FIG. 6 to refer to common components with other FIGS and no further discussion of these common components, except to the extent necessary to explain operation of the circuit 100, will be provided. The generator 204 comprises a set of series, diode connected, N type transistors 15*a*,16*a* and 22. The current source 208 comprises an N type transistor 24 whose drain is connected to the source of transistor 15*c*, whose source is connected to ground, and whose gate is connected to the gate of transistor 16*a* in the generator 204. It should be noted that the implementation of FIG. 6 differs from the implementation of FIG. 3 in that transistors 14*b* and 15*b* are not utilized.

Figure 7:
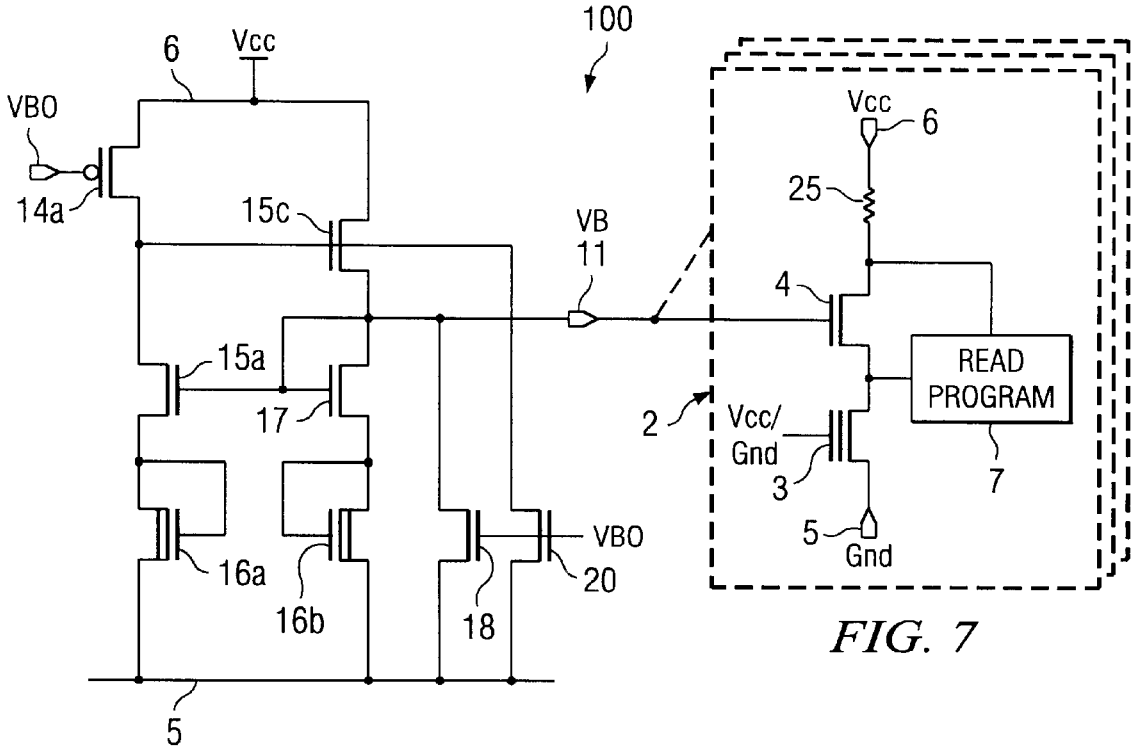
Figure 8:
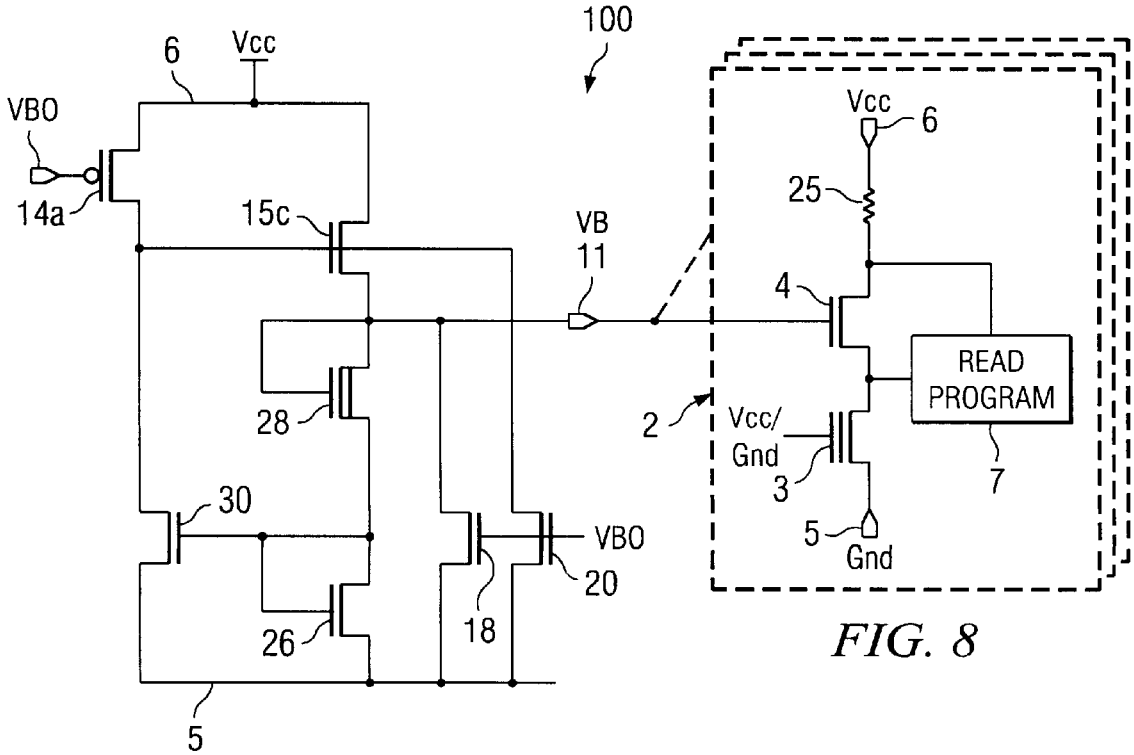
Figure 9:
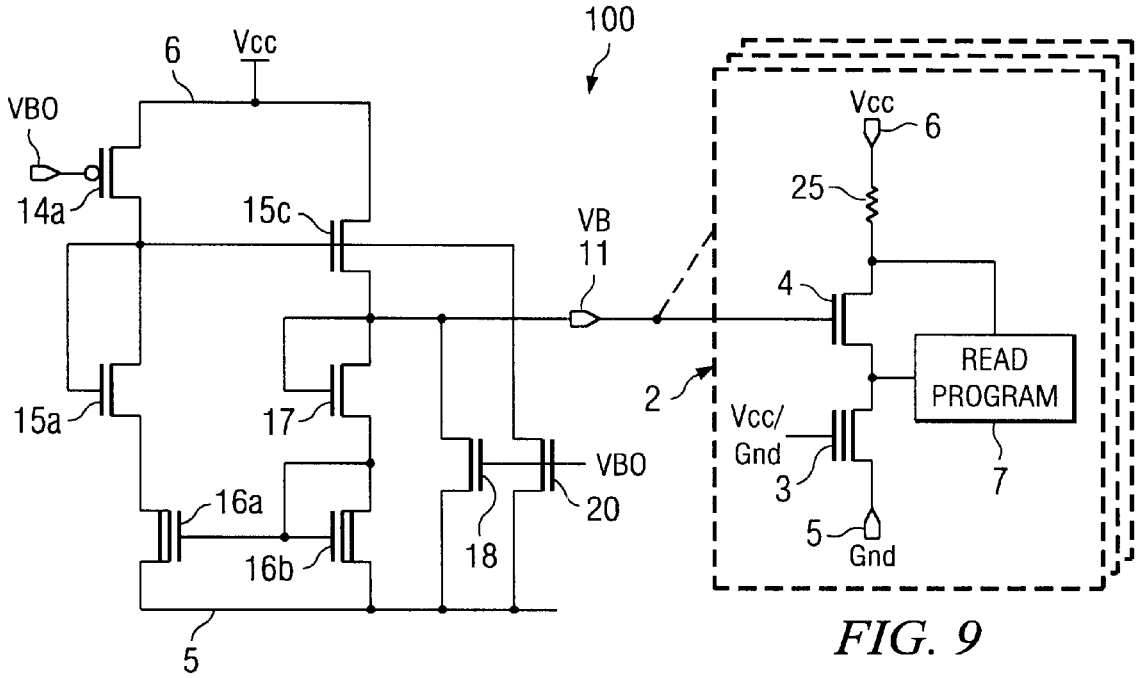
Figure 10:
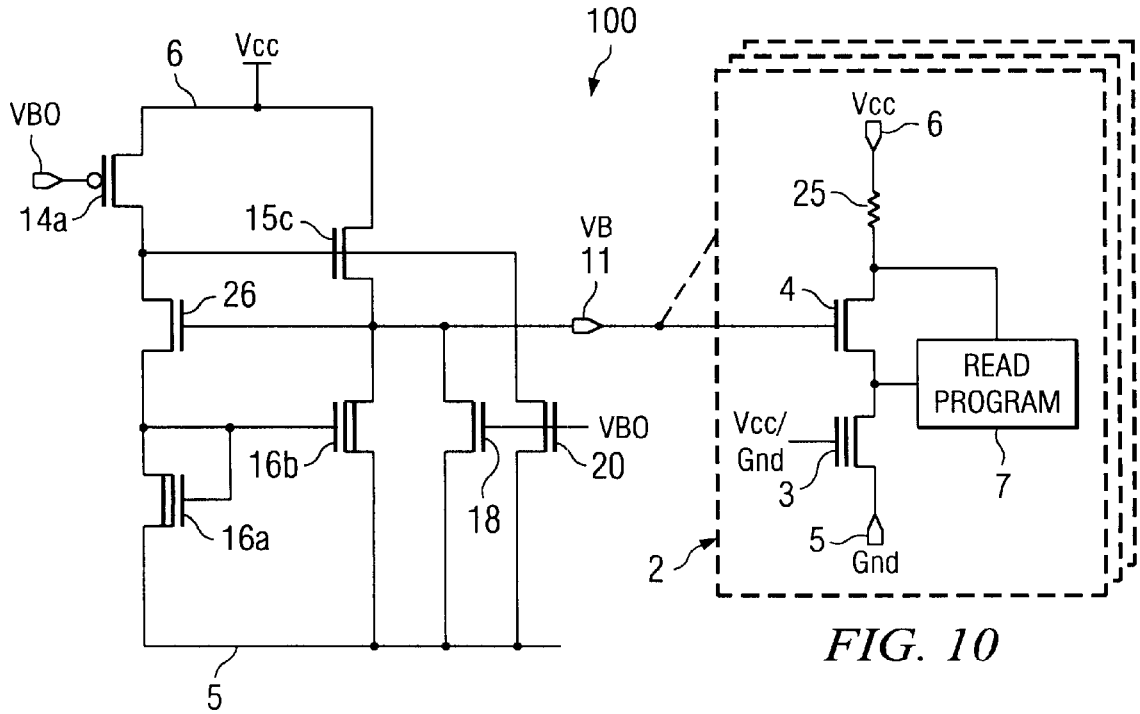

It is further recognized that other alternative embodiments of the circuit 100 may be constructed as shown in FIGS. 7–10. Each of these embodiments, generally speaking, operate in the same manner as the circuit 100 illustrated in FIGS. 3, 5 and 6, and described above. More specifically, FIG. 7 shows the circuit 100 similar to that of FIG. 3, except without use of transistors 14*b* and 15*b*. FIG. 8 shows the circuit 102 in an implementation similar to that of FIG. 7 except that the depletion and enhancement mode devices in the series connected stack formed by transistors 16*b* and 17 have exchanged places (see, transistors 26 and 28) and the transistors 15*a* and 16*a* have been replaced by an N type transistor current source 30 connected in a current mirror configuration with the transistor 26. FIG. 9 shows the circuit 102 in an implementation similar to that of FIG. 3 except that the current mirror (provided by transistors 16*a* and 16*b*) is formed with depletion mode devices. FIG. 10 shows the circuit 100 with the current mirror orientation exchanged around and formed with depletion mode devices. It will, of course, be understood that enhancement mode devices could also be used.

With the use of the circuits described herein, the supplied current driver operates in a class AB manner to allow high current upon demand to the capacitive load of the output line upon demand while still allowing for a low quiescent current. This is facilitated due to the fact that the included source follower circuit does not have an intentionally included (for example, separately supplied) resistive element in its drain circuit. In the circuit configuration(s), responsive to the applied control signal, the driver is either activated or deactivated, and when activated the capacitive output line is driven with the current towards the bias voltage with a current greater than its quiescent value in order to achieve a more rapid biasing. When deactivated, on the other hand, the bias driver consumes substantially zero power.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A transistor bias circuit receiving a control signal, comprising:

an input connected to receive the control signal;

a bias circuit output for applying an output bias voltage to a control terminal of at least one transistor;

a reference voltage generator that generates an output voltage responsive to a first transition in the control signal; and a voltage follower having an input connected to receive the output voltage from the reference voltage generator and an output connected to the bias circuit output, the voltage follower operating in transient conditions with respect to the output bias voltage to source a boost current at its output to rapidly charge the bias circuit output;

wherein the bias circuit output applies the output bias voltage and the boost current to bias up the at least one transistor.

2. The bias circuit of claim 1 wherein the bias circuit is fabricated as an integrated circuit.

3. A bias circuit receiving a control signal, comprising:

an input connected to receive the control signal;

a bias circuit output for applying an output bias voltage;

a reference voltage generator that generates an output voltage responsive to a first transition in the control signal;

a voltage follower having an input connected to receive the output voltage from the reference voltage generator and an output connected to the bias circuit output, the voltage follower operating in transient conditions with respect to the output bias voltage to source a boost current at its output to rapidly charge the bias circuit output; and a first protection circuit operating responsive to a second transition in the control signal to pull the input of the voltage follower to ground.

4. The bias circuit of claim 3 further including a second protection circuit also operating responsive to the second transition in the control signal to pull the bias circuit output to ground.

5. The bias circuit of claim 3 wherein the voltage follower comprises a first transistor having a gate and the first protection circuit comprises a second transistor drain to source connected between the gate of the first transistor and ground, the second transistor having a gate receiving the control signal.

6. A bias circuit receiving a control signal, comprising:

an input connected to receive the control signal;

a bias circuit output for applying an output bias voltage;

a reference voltage generator that generates an output voltage responsive to a first transition in the control signal; and a voltage follower having an input connected to receive the output voltage from the reference voltage generator and an output connected to the bias circuit output, the voltage follower operating in transient conditions with respect to the output bias voltage to source a boost current at its output to rapidly charge the bias circuit output, wherein the voltage follower comprises a source follower configured transistor.

7. A bias circuit receiving a control signal, comprising:

an input connected to receive the control signal;

a bias circuit output for applying an output bias voltage;

a reference voltage generator that generates an output voltage responsive to a first transition in the control signal;

a voltage follower having an input connected to receive the output voltage from the reference voltage generator and an output connected to the bias circuit output, the voltage follower operating in transient conditions with respect to the output bias voltage to source a boost current at its output to rapidly charge the bias circuit output; and a current source connected between the voltage follower output and ground.

8. The bias circuit of claim 7 wherein the current source and the reference voltage generator are connected in a current mirror configuration.

9. A bias circuit receiving a control signal, comprising:

an input connected to receive the control signal;

a bias circuit output for applying an output bias voltage;

a reference voltage generator that generates an output voltage responsive to a first transition in the control signal;

a voltage follower having an input connected to receive the output voltage from the reference voltage generator and an output connected to the bias circuit output, the voltage follower operating in transient conditions with respect to the output bias voltage to source a boost current at its output to rapidly charge the bias circuit output; and a storage circuit including an isolation transistor having a gate and a floating gate transistor;

wherein the bias circuit output is connected to the gate of the isolation transistor for applying the output bias voltage and the boost current to the storage circuit.

10. The bias circuit of claim 9 wherein the bias circuit including the storage circuit is fabricated as an integrated circuit.

11. A bias circuit receiving a control signal, comprising:

an input connected to receive the control signal;

a bias circuit output for applying an output bias voltage to a control terminal of at least one transistor;

a reference voltage generator connected to the bias circuit output that generates the output bias voltage responsive to a first transition in the control signal; and a source follower having an input connected to receive an indication of output bias voltage generation by the reference voltage generator and an output connected to the bias circuit output, the source follower operating responsive to the indication to source a boost current at its output to rapidly charge the bias circuit output;

wherein the bias circuit output applies the output bias voltage and the boost current to bias up the at least one transistor.

12. The bias circuit of claim 11 wherein the source follower comprises a first transistor having a gate and the first protection circuit comprises a second transistor drain to source connected between the gate of the first transistor and ground, the second transistor having a gate receiving the control signal.

13. The bias circuit of claim 11 wherein the bias circuit is fabricated as an integrated circuit.

14. A bias circuit receiving a control signal, comprising:

an input connected to receive the control signal;

a bias circuit output for applying an output bias voltage;

a reference voltage generator connected to the bias circuit output that generates the output bias voltage responsive to a first transition in the control signal;

a source follower having an input connected to receive an indication of output bias voltage generation by the reference voltage generator and an output connected to the bias circuit output, the source follower operating responsive to the indication to source a boost current at its output to rapidly charge the bias circuit output; and a first protection circuit operating responsive to a second transition in the control signal to pull the input of the source follower to ground.

15. The bias circuit of claim 14 wherein said source follower has no intentional separate resistive element in its drain circuit.

16. The bias circuit of claim 14 further including a second protection circuit also operating responsive to the second transition in the control signal to pull the bias circuit output to ground.

17. A bias circuit receiving a control signal, comprising:

an input connected to receive the control signal;

a bias circuit output for applying an output bias voltage;

a reference voltage generator connected to the bias circuit output that generates the output bias voltage responsive to a first transition in the control signal;

a source follower having an input connected to receive an indication of output bias voltage generation by the reference voltage generator and an output connected to the bias circuit output, the source follower operating responsive to the indication to source a boost current at its output to rapidly charge the bias circuit output; and a storage circuit including an isolation transistor having a gate and a floating gate transistor;

wherein the bias circuit output is connected to the gate of the isolation transistor for applying the output bias voltage and the boost current to the storage circuit.

18. The bias circuit of claim 17 wherein the bias circuit including the storage circuit is fabricated as an integrated circuit.

19. An apparatus for rapidly charging a transistor control terminal which may have substantial capacitance associated therewith, said apparatus comprising:

a voltage reference generator;

a current driving stage;

wherein said current driving stage operates in a class AB manner to allow high current upon demand to bias up the transistor control terminal while still allowing for low quiescent current.

20. A transistor bias circuit receiving a control signal, comprising:

a bias voltage generator including an input connected to receive the control signal and an output, the bias voltage generator producing an output voltage signal that transitions from a first value to a second value in response to a change in the control signal;

a boost circuit operating responsive to the transition of the output voltage signal from the first value to generate a boost current; and means for combining the output voltage signal and the boost current as an output bias voltage for application to a control terminal of at least one transistor for the purpose of biasing up that transistor.

21. The bias circuit as in claim 20 wherein the boost circuit comprises a voltage follower having an input connected to receive the voltage signal from the bias voltage generator and an output connected to a bias circuit output, the voltage follower operating in transient conditions with respect to the voltage signal to source the boost current at its output to rapidly charge the bias circuit output.

22. The bias circuit as in claim 20 wherein the boost circuit comprises a source follower having an input connected to receive an indication of voltage signal generation by the bias voltage generator and an output connected to a bias circuit output, the source follower operating responsive to the indication to source a boost current at its output to rapidly charge the bias circuit output.

23. The bias circuit as in claim 20 further including a protection circuit operating responsive to the control signal to pull the boost circuit to ground.

24. The bias circuit as in claim 20 further including:

a storage circuit including an isolation transistor having a gate and a floating gate transistor;

wherein the output bias voltage is applied to the gate of the isolation transistor.

25. The bias circuit as in claim 24 wherein the bias circuit including the storage circuit is fabricated as an integrated circuit.

26. The bias circuit of claim 20 wherein the bias circuit is fabricated as an integrated circuit.

27. A bias circuit receiving a control signal, comprising:

a bias voltage generator including an input connected to receive the control signal and an output, the bias voltage generator producing a voltage signal that transitions from a first value to a second value in response to a change in the control signal;

a boost circuit operating responsive to the transition of the voltage signal from the first value to generate a boost current;

means for combining the voltage signal and the boost current as an output bias voltage; and a protection circuit operating responsive to the control signal to pull the boost circuit to ground;

wherein the boost circuit comprises a transistor having a control gate, the protection circuit pulling the control gate of the transistor to ground.

28. A method for generating a transistor bias voltage, comprising the steps of:

generating a bias voltage output signal that transitions from a first value to a second value in response to a change in a control signal;

applying the bias voltage output signal to a control terminal of a transistor;

detecting transition of the bias voltage output signal from the first value;

generating a boost current in response to the detected transition in the bias voltage output signal; and applying the boost current in combination with the bias voltage output signal and thus rapidly achieve the output bias voltage at the control terminal of the transistor.

29. The method as circuit as in claim 28 further including the steps of:

detecting transition of the bias voltage signal towards the second value; and terminating boost current generation in response to the detected transition.

30. Apparatus for rapidly charging a control terminal of a transistor to a bias voltage, the apparatus employing a bias driver, the bias driver comprising:

a voltage reference generator;

an input receiving a control signal;

a current driver circuit;

wherein the control signal is effective to either activate or deactivate the bias driver, and when activated, the current driver operating to charge the capacitive line to a desired bias voltage responsive to said voltage reference generator with an amount of current greater than its quiescent value in order to achieve a rapid charging of said transistor control terminal.

31. The apparatus of claim 30 wherein the bias driver, when deactivated responsive to the control signal, consumes substantially zero power.

32. A transistor control terminal biasing circuit, comprising:

a bias voltage generator responsive to an input signal and having an output terminal to which an output bias voltage is supplied, the output terminal for connection to a transistor control terminal; and a boost current generator configured for feedback loop operation to sense voltage transitions at the output terminal and respond to a sensed voltage transition changing from about zero volts by supplying relatively large amounts of boost current to the output terminal and further respond to a sensed voltage transition approaching a target bias voltage by reducing the boost current supplied to the output terminal.

33. The biasing circuit of claim 32 further including:

a storage circuit including an isolation transistor having a gate and a floating gate transistor;

wherein the output terminal is connected to the gate of the isolation transistor for applying the output bias voltage and the boost current to the storage circuit.

34. A method for transistor control terminal biasing, comprising the steps of:

generating an output bias voltage in response to an input signal for application to a transistor control terminal;

sensing voltage transitions in the output bias voltage;

responding to a sensed voltage transition changing from about zero volts by supplying relatively large amounts of boost current for application with the output bias voltage to the transistor control terminal; and responding to a sensed voltage transition approaching a target bias voltage by reducing the amount of boost current supplied to the transistor control terminal.

* * * * *